United States Patent [19]

Whitefield

[11] 4,375,178

[45] Mar. 1, 1983

[54] DYNAMIC FREQUENCY MODULATION CONTROLLER FOR AN ELECTRONIC MUSICAL INSTRUMENT

[75] Inventor: John T. Whitefield, Harleysville, Pa.

[73] Assignee: Allen Organ Company, Macungie, Pa.

[21] Appl. No.: 245,601

[22] Filed: Mar. 20, 1981

[51] Int. Cl.[3] ..... G10H 1/02

[52] U.S. Cl. ..... 84/1.25

[58] Field of Search ..... 84/1.01, 1.03, 1.24, 84/1.25

[56] References Cited

U.S. PATENT DOCUMENTS

| | | | |
|---|---|---|---|
| 3,286,013 | 11/1966 | Brand et al. | 84/1.25 |
| 3,288,907 | 11/1966 | George | 84/1.25 |
| 3,515,792 | 6/1970 | Deutsch | 84/1.03 |
| 3,590,133 | 6/1971 | Schwartz et al. | 84/1.24 |
| 3,609,204 | 9/1971 | Peterson | 84/1.25 |
| 3,610,799 | 10/1971 | Watson | 84/1.01 |
| 3,639,913 | 2/1972 | Watson | 84/1.01 X |
| 3,757,022 | 9/1973 | Markowitz | 84/1.25 |
| 3,951,030 | 4/1976 | Deutsch | 84/1.25 |
| 3,973,463 | 8/1976 | Schreier | 84/1.25 |
| 4,000,676 | 1/1977 | Love | 84/1.25 |
| 4,083,284 | 4/1978 | Nakada | 84/1.25 |
| 4,086,838 | 5/1978 | Kawamura | 84/1.25 |
| 4,198,892 | 4/1980 | Gross | 84/1.25 |

*Primary Examiner*—Stanley J. Witkowski
*Attorney, Agent, or Firm*—Sanford J. Piltch

[57] ABSTRACT

In an electronic musical instrument having at least one keyboard with keys corresponding to the notes of a musical scale apparatus for controlling the dynamic frequency modulation of tones reproduced from key pulses associated with active keys of the keyboard including a tonal effect control for selecting one of the desired modulation effects, vibrato, delayed vibrato or decayed vibrato, a multiplexed counter having a plurality of distinct sequential time periods for creating a delay proportional to its counting rate for generating output signals for controlling the time variant parameters of the modulation effects, a triggering means for initiating individually a count in each of the time periods of the counter in response to the generation of a key pulse, at least one count source for controlling the counting rate of the counter, a comparator for disabling the count in any of the time periods of the counter and timing alignment means for realigning the output signals of the counter with the corresponding key pulse whereby the frequency modulated tone reproduced in response to a key pulse and the output control signals of the counter corresponding to such key pulse will be for any keying sequence independent of the effect of any key actuations occurring either prior or subsequent thereto.

16 Claims, 13 Drawing Figures

DYNAMIC FREQUENCY MODULATION CONTROLLER FOR AN ELECTRONIC MUSICAL INSTRUMENT

BACKGROUND OF THE INVENTION

Some musical instruments are played with a technique that produces a periodic change in frequency called vibrato. The vibrato characteristic is controlled by the player of the musical instrument and thus can be made more subtle or exaggerated at will. Very often it is desired that the vibrato effect occur only during sustained notes and not during rapid note sequences. For effect, the musician may choose to play a sustained note initially without vibrato and then gradually bring in the vibrato effect with increasing depth. This effect is called delayed vibrato. Further, some musical instruments exhibit frequency modulation of varying degrees at the onset of an audible tone with a diminishing effect as time passes. This modulation effect can be subtle, as a slight dip in frequency, or exaggerated, as several vibrato cycles. Such an effect may be called decayed vibrato. The combined effects of delayed vibrato and decayed vibrato, as they apply to electronic musical instruments, is the subject of this invention.

The two effects described above, delayed and decayed vibrato, have been implemented to varying degrees in digital electronic musical instruments in the past. However, the time variant parameters of these effects have not been responsive on an individually selective basis. That is to say, on an electronic musical instrument having a keyboard, these effects were not responsive on an individual key basis. If one key was held down while other keys were being played, either the latter notes would cause the resulting audible tone from a prior sustained note to be affected or the latter notes would not exhibit the desired dynamic modulation effect. In contrast, the present invention discloses a dynamic modulation controlled exhibiting independent response to each new key depression.

Some of the reasons for the creation of these dynamic modulation effects may be from among the following. Delayed vibrato has been used on certain electronic musical instruments for creating the effect of a stringed-instrument sound in a more accurate manner. The vibrato effect causes changes in the pitch of the resulting audible tone which is detected by the listener as an alternate sharping and flatting of the tone. Thus, the addition of a vibrato effect to a rapidly keyed sequence of notes has a certain detuning effect as heard by the listener. If the musician desires to rapidly key the electronic musical instrument to reproduce a desired sound, the delayed vibrato effect permits the electronic musical instrument to reproduce such sounds corresponding to depressed keys without the instantaneous detuning effects of non delayed vibrato. Without such delay a listener could detect an instantaneous detuning of the reproduced tones from a rapid keying sequence with the non delayed vibrato enabled.

The second dynamic modulation effect is decayed vibrato. This is an effect which would in general not be completely controlled by the player but would be an inherent characteristic of an instrument. An example of such a natural effect can be observed when a stringed instrument is plucked. When decayed vibrato is selected, it causes an immediate frequency modulation followed by a decay of the modulation to a sustained tone. Thus, a realism in reproducing percussive effects by an electronic musical instrument is achieved. Both the delayed and decayed vibrato effects may be manually set to control both the depth and rate of change of the effects. These manually controlled characteristics will be discussed more fully hereinafter. It should be noted that neither the delayed nor the decayed vibrato has any tonal dependence among the depressed keys. For any given keying sequence these modulation effects are entirely independent of the keys depressed prior to the enabling of the effect and those depressed subsequently.

Accordingly, it is an object of this invention to provide both delayed and decayed vibrato in an electronic musical instrument where the time variant parameters of such effects are responsive to individually depressed keys.

A further object of the present invention is to provide for the control of the depth of each of the two effects, delayed and decayed vibrato. The depth of each effect being the degree to which the frequency of the reproduced tone deviates from its nominal pitch.

Another object of the present invention is to provide for the control of the rate of change or deviation of the time period of each of the effects, delayed and decayed vibrato.

Other objects will appear hereinafter.

SUMMARY OF THE INVENTION

In an electronic musical instrument which has at least one keyboard with keys corresponding to the notes of a musical scale the dynamic frequency modulation controller of the present invention causes the tones reproduced from the key pulses associated with the active keys on a keyboard to respond to the selected modulation effect on an independent basis. The dynamic frequency modulation controller comprises a tonal effect control means for selecting one of the desired modulation effects, vibrato, delayed vibrato, decayed vibrato; a counting means having multiple channels for creating a delay proportional to its counting rate to generate a first output control signal having a timing indicative of the selected modulation effect and second and third output control signals indicative of the depth control for each such effect; triggering means for initiating a count on a channel of the counting means in response to the generation of a key pulse resulting from the activation of a key; a count source means for controlling the counting rate of the counting means; comparator means for disabling any channel of the counting means when a selected depth control setting is reached; and timing alignment means for realigning the first, second and third output control signals of the counting means with the corresponding key pulse. The dynamic frequency modulation controller allows manual preselection of both depth and rate of change or deviation of the time period of the selected effect. The controller is structured to be responsive to triggering or count initiating pulses in accordance with the time sequence relationship of these pulses to their corresponding key pulses in such a manner that the number of channels in the controller is equal to the number of tone generators in the electronic musical instrument. Likewise, the comparator means operates by comparing preselected values with counter values on a channel by channel basis disabling only those channels which have reached the preselected values. This structure or its equivalent procedural steps permits the tone with its associated dynamic frequency modulation reproduced in response to a key pulse and the associated output control signals of the counting means to be independent of the effect of any other key pulses occurring either prior or subsequent thereto.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 4:
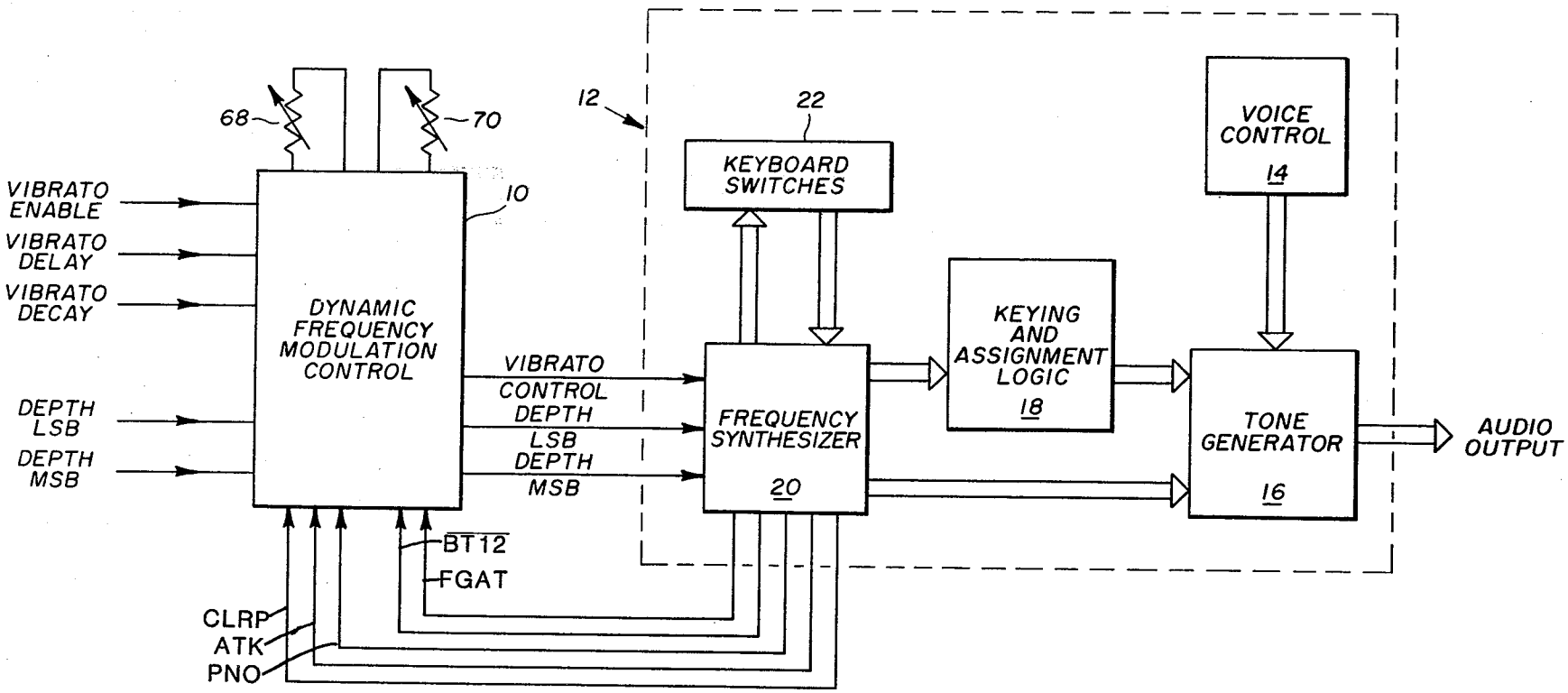
FIG. 4 is a block diagram of the dynamic frequency modulation controller of the present invention as it relates to an electronic musical instrument.

Referring to the drawings in detail, wherein like numerals indicate like elements, there is shown in FIG. 4 the overall relationship of the dynamic frequency modulation controller 10 to the electronic musical instrument 12. The electronic musical instrument or, in the preferred embodiment, a digital organ system is of the type described in U.S. Pat. No. 3,610,799 issued Oct. 5, 1971 to George A. Watson. Such a digital organ system is also described in U.S. Pat. No. 3,639,913 issued Feb. 1, 1972 to George A. Watson. These patents describe specific conventional details of the structure and operation of the digital electronic organ system and are incorporated herein by reference.

Before describing in detail the dynamic frequency modulation control of the present invention, it is helpful to summarize the digital electronic organ system disclosed in U.S. Pat. Nos. 3,610,799 and 3,639,913. Operation of the digital organ system is based on the principle that any periodic waveform can be reconstructed by sampling the amplitude of the waveform at a number of discrete regularly spaced intervals. This basic concept is disclosed in U.S. Pat. No. 3,515,792 wherein the sample points of the waveform are stored in memory and read out at a selectively controlled rate. The highest harmonic component which can be accurately reproduced in the waveform is proportional to the number of sample points in the waveform. The greater the number of sample points, the higher the harmonic content capable of being accurately produced. The harmonic structure of a sound or tone, therefore, is determined in the first instance by the array of binary numbers representative of sample points of the waveform. These binary number representations of sample points may be stored either temporarily or permanently in the voice control 14 of the electronic musical instrument 12. The reproduced tone is identified by its frequency, or pitch. The frequency or pitch is governed by the rate at which the stored sample points are read from the memory in the tone generator 16. The tone generator 16 accepts control signals from the keying and assignment logic 18 and the frequency synthesizer 20 of the electronic musical instrument 12. The signals control the writing into the memories of the tone generator 16 from the voice control 14 and the reading out of the memories the binary number representation of the sample points of the waveform from the tone generator 16 to an audio amplifier. The frequency synthesizer 20 also controls the scanning of the keyboard switches 22 so that the resulting information regarding key depression takes on a specialized format in a time division multiplexed scheme. This specialized time division multiplexed format provides for the keying assignment logic 18 along with the frequency synthesizer 20 to control the tone generator 16 in accordance with the multiplexed format to reproduce audible tones corresponding to active keys on the keyboards.

The dynamic frequency modulation controller 10 operates by using certain control signals generated by the frequency synthesizer 20 in the time division multiplexed format. These control signals, which will be more fully described hereinafter, control the flow of information through the dynamic frequency modulation controller 10 to the frequency synthesizer 20 and ultimately to the tone generator 16 of the electronic musical instrument 12. The dynamic frequency modulation controller 10 also has other inputs for controlling the depth of the modulation and certain enabling signals which will also be described more fully hereinafter.

Figure 1:
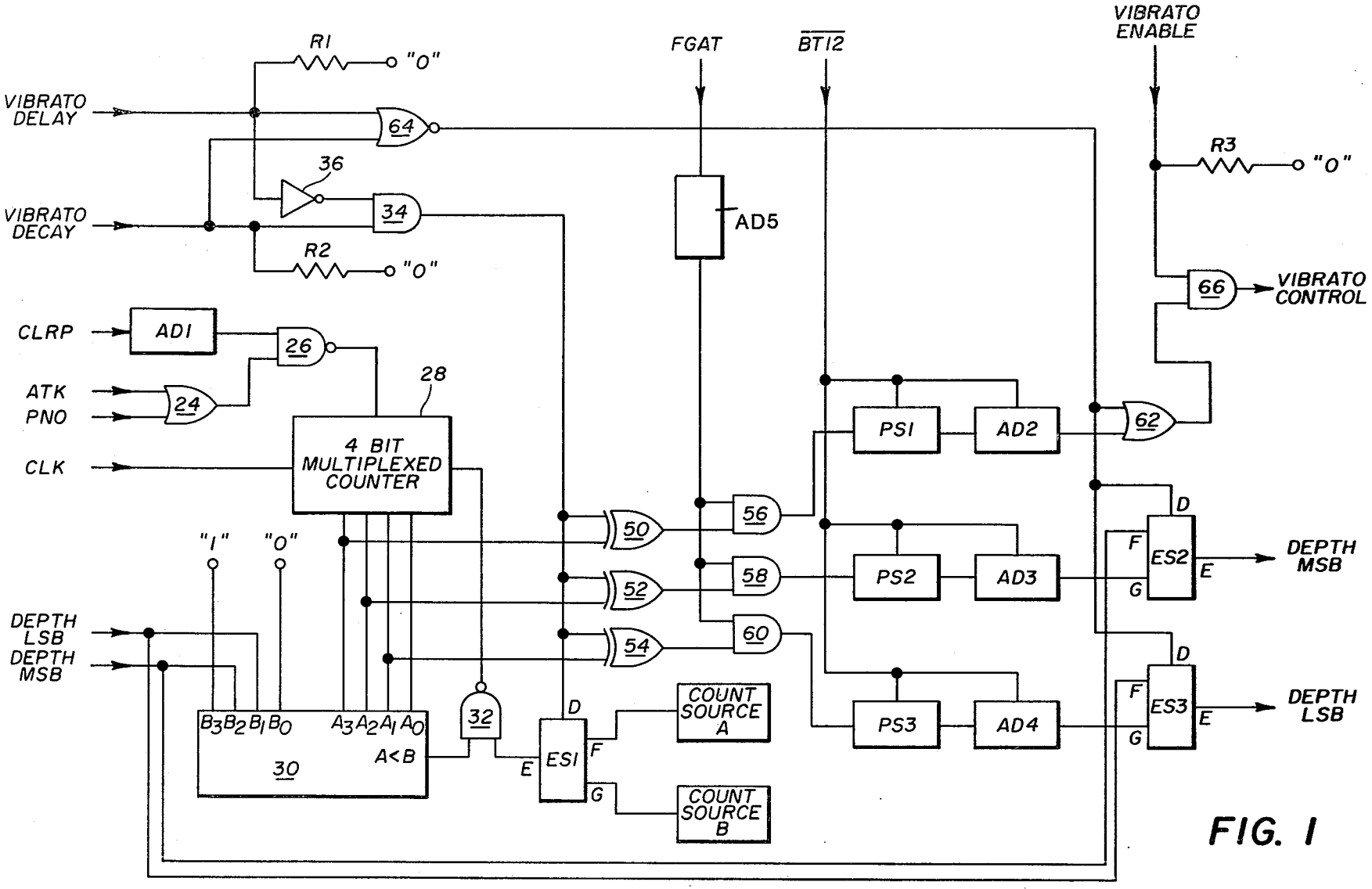
FIG. 1 is a logic diagram of the dynamic frequency modulation controller of the present invention.
Figures 5A, 5B:
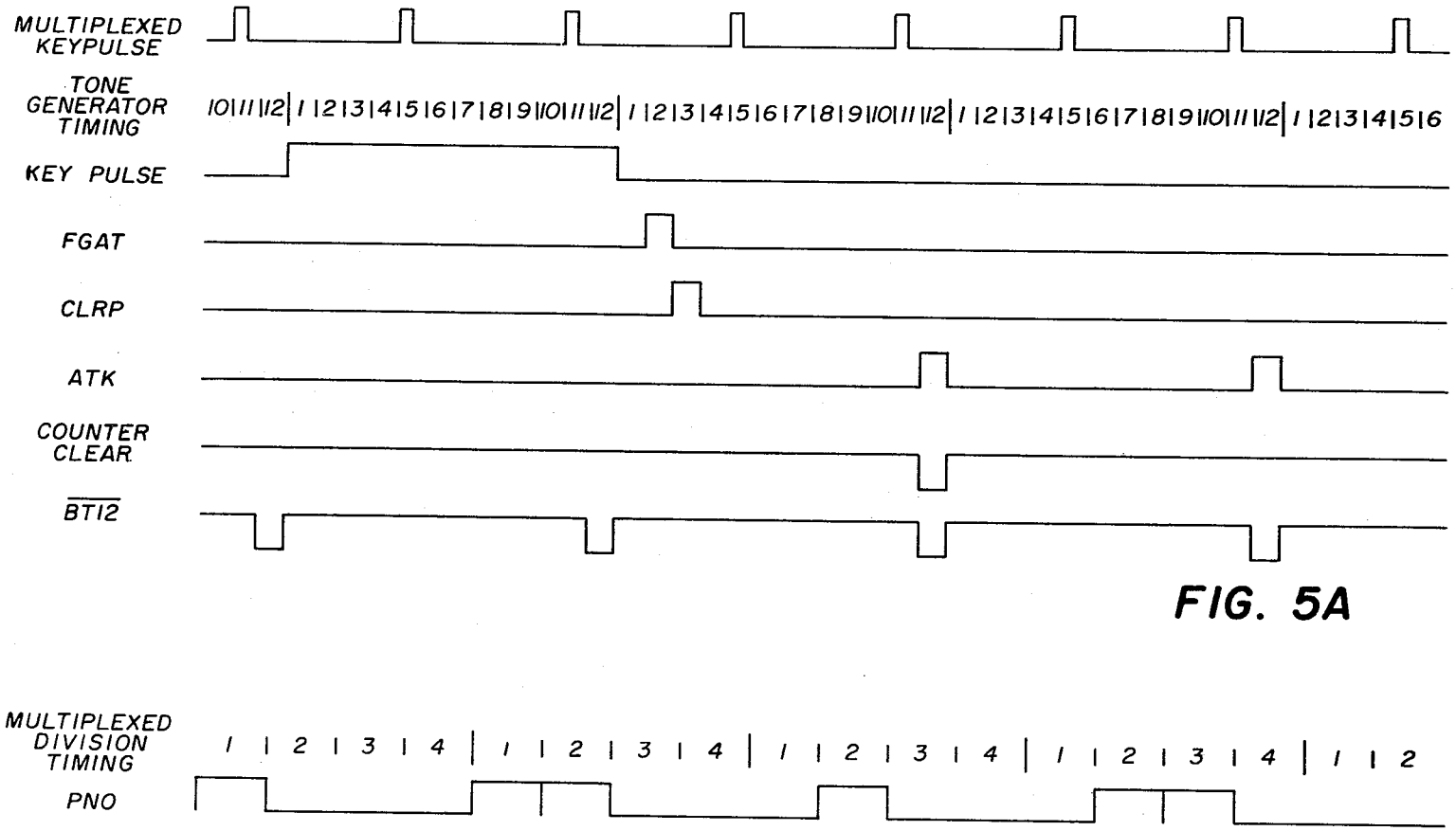
FIG. 5A is a timing diagram showing the relationships in a multiplexed format of the control signals of the present invention.
FIG. 5B is a timing diagram showing the relationships in a multiplexed format of a control signal, PNO, of the present invention.

Referring now to FIG. 1, a multiplexed system for controlling the dynamic frequency modulation of vibrato in an electronic musical instrument is shown. The CLRP signal resulting from the depression of a key on a keyboard of the electronic musical instrument 12 is aligned in time by an alignment delay device AD1 to coincide with the attack signal ATK. The timing differential of the CLRP and the ATK is shown in FIG. 5A and will be more fully described hereinafter. The ATK signal is applied to one input of OR gate 24 with the PNO signal applied to the other input. The PNO signal is a multiplexed indication of a stop tab in the voice control 14 being selected to cause a percussive effect during the time of a keyboard scan of each keyboard included in the electronic musical instrument 12. Thus the PNO signal will exhibit a 1 logic level during the scan time when the stop tab for the percussive effect is enabled for a specific keyboard and a 0 logic level during the scan time of a keyboard where the percussive effect was not selected. See FIG. 5B. The resulting signals from OR gate 24 and AD1 are combined in NAND gate 26 and applied to the four bit multiplexed counter 28 as the counter clear signal. The counter clear signal is a negative going pulse, as shown in FIG. 5A, and is used to reset the counter outputs A0, A1, A2 and A3 to a low state so that the counter 28 may begin to count. The outputs A0–A3 of the counter 28 are connected to a four bit magnitude comparator 30 which compares the magnitude of its A inputs to the magnitude of its B inputs. The A inputs of the comparator 30 are connected to the outputs of counter 28 with the least significant bit output of the counter connected to the least significant bit input of the comparator with each ascending bit connected from one device to the others in a like manner. The B inputs of the comparator 30 are connected as follows. The B0 input which is representative of the least significant bit is connected to a logical 0. The B3 input which is representative of the most significant bit is connected to a logical 1. The B1 input is connected to the least significant bit of the vibrato depth control. The B2 input is connected to the most significant bit of the vibrato depth control. Based on a desired maximum vibrato depth, comparator 30 will generate a logical 1 on its A<B output when the magnitude of the A inputs is less than the magnitude of the B inputs and a logical 0 when the magnitude of the A inputs is equal to or greater than the magnitude of the B inputs. The A<B output of comparator 30 is connected to one input of NAND gate 32. This input to the NAND gate 32 controls the counting done by the counter 28. The other input of NAND gate 32 is connected to the E output of an electronic switch ES1 which switches between two count sources, count source A and count source B, depending upon the logical value at its D input. The D input of ES1 is connected to the output of AND gate 34 which acts as a selection means for either delayed or decayed vibrato. Each signal, delayed or decayed vibrato enable, originates with a switch, which may be a stop tab on an organ or such other equivalent as one skilled in the art may use, connected at one end to a voltage source so that the position of the switch will create a signal indicative of the desired control function. The decayed vibrato enable signal is connected to one input of AND gate 34. The delayed vibrato signal is propagated through inverter 36 to the other input of AND gate 34. A logical zero occurring on the output of AND gate 34 is indicative of delayed vibrato being selected. Similarly, a logical 1 appearing on the output of AND gate 34 is indicative of decayed vibrato being selected. Switch ES1 responds to the different logic levels by switching between count source A and count source B depending upon which logical level is present. If delayed vibrato is enabled, count source A is connected through switch ES1 and NAND gate 32 to control the counting rate of counter 28 through its clock input. Likewise, if decayed vibrato is enabled, switch ES1 switches to enable count source B for controlling the counting rate of counter 28. As long as the A<B output of comparator 30 remains at its logical 1 value, the counting rate input of counter 28 will be connected to a count source enabling the counter to count to its maximum value. When the A<B output value of comparator 30 switches to a logical 0, as the magnitude of the A inputs equals the magnitude of the B inputs, gate 32 becomes inactive disabling the counting rate input of the counter 28.

Figure 2:
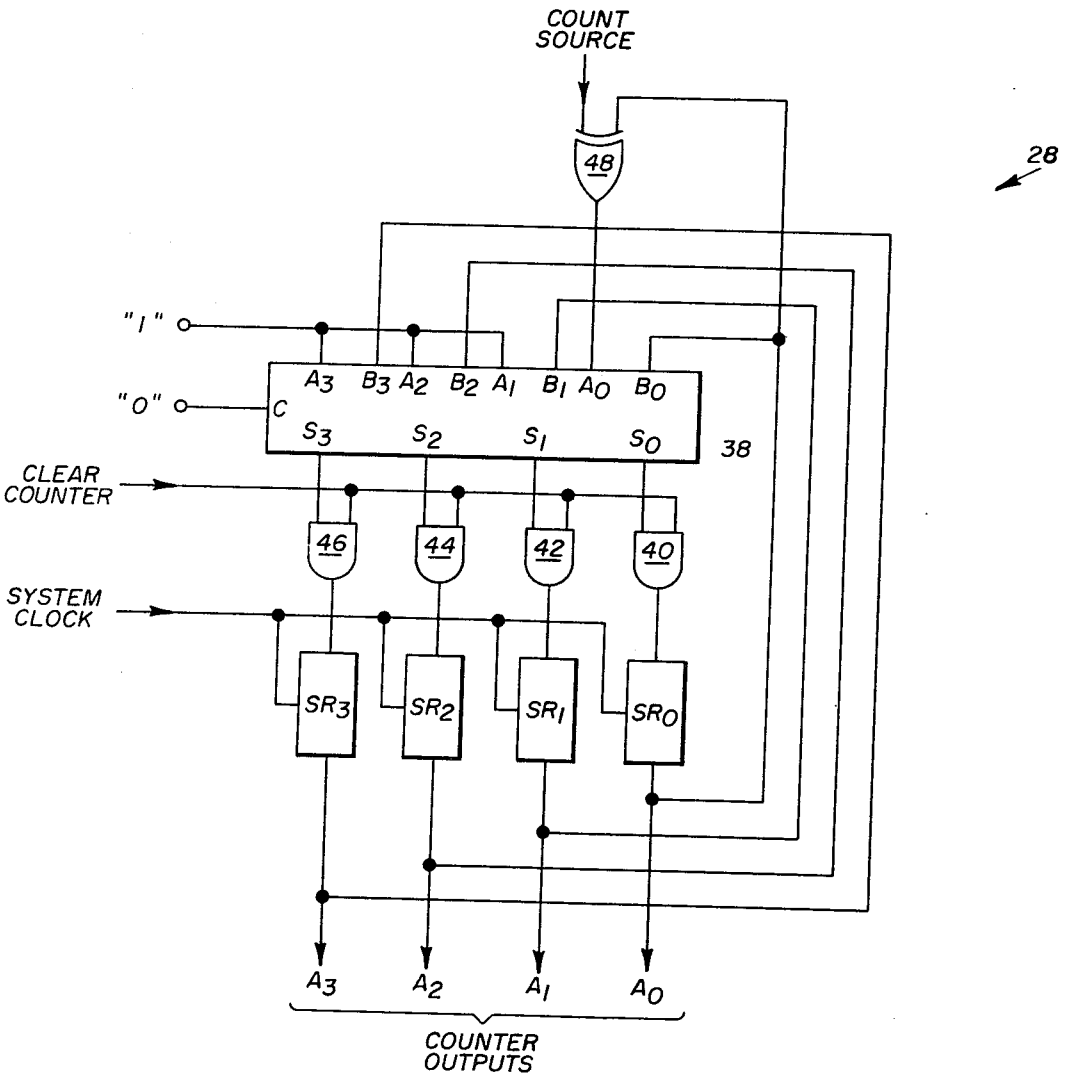
FIG. 2 is a logic diagram of the four-bit multiplexed counter of the dynamic frequency modulation controller of the present invention.
Figures 3A, 3B, 3C:
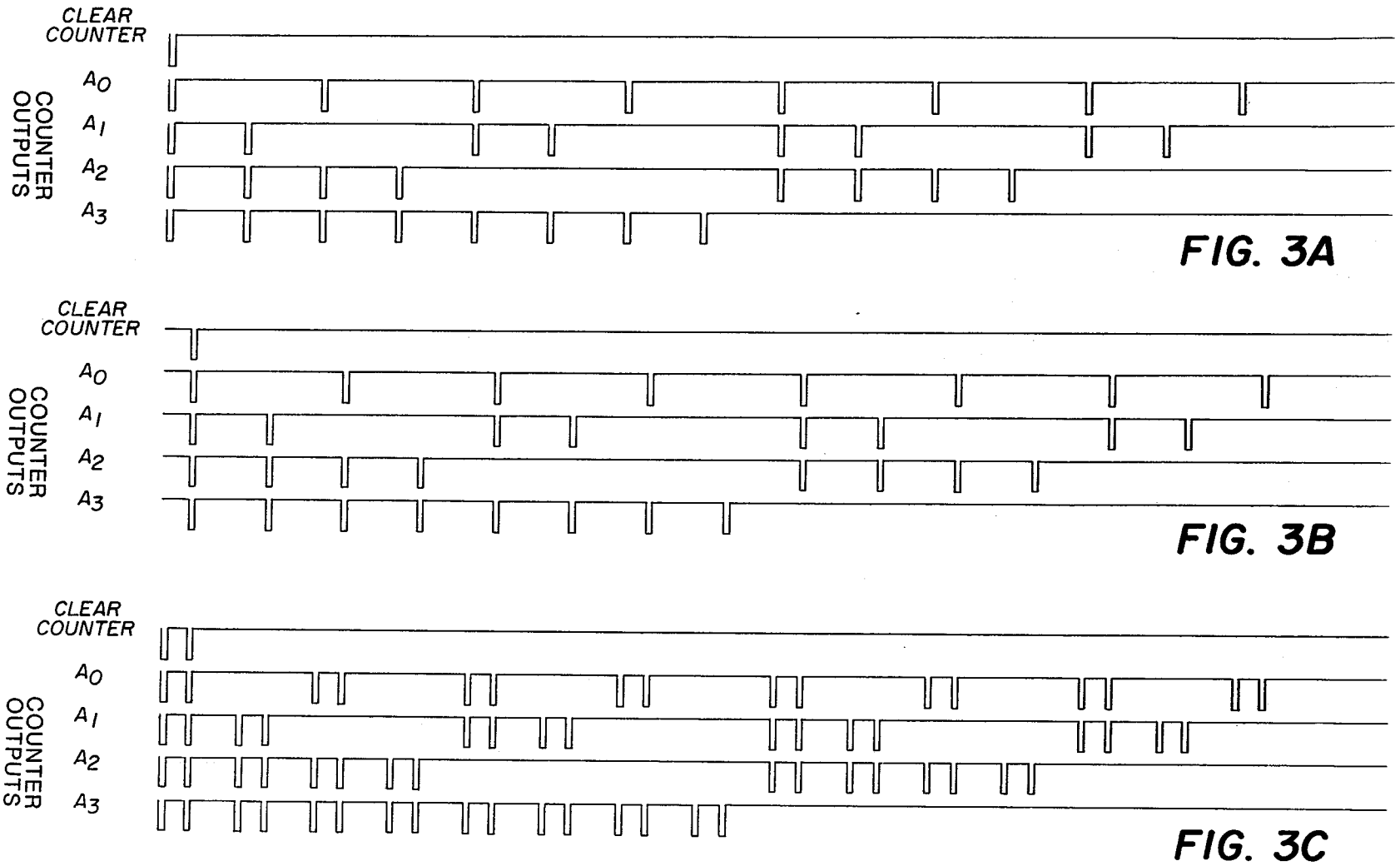
FIG. 3A is a timing diagram of the outputs and the clear input of the four-bit multiplexed counter showing the resulting count in the first time period position.
FIG. 3B is a timing diagram of the outputs and the clear input of the four-bit multiplexed counter showing the resulting count in the fifth time period position.
FIG. 3C is a timing diagram of the outputs and the clear input of the four-bit multiplexed counter showing the multiplexed relationship of the counter signals in both the first and fifth time period positions.

The four-bit multiplexed counter 28 is shown in FIG. 2 in its logical configuration. The counter 28 consists of a four-bit adder 38 which may be a type 4008 adder or such equivalent which can be constructed by one skilled in the art. The adder 38 has four sets of parallel inputs designated A0, B0 through A3, B3. Inputs A1, A2 and A3 are connected to a logical 1 to facilitate the particular counting operation required. The C or carry input of adder 38 is connected to a logical 0 to facilitate the functioning of the required count. Each pair of inputs, an A and a B, are connected internally in the adder to sum outputs S0 through S3, respectively. A logical 1 appearing on either the A or the B input will cause the S output to have a value of a logical 1. If both the A and B inputs have values of logical 1's, the corresponding S output will have a value of a logical 0 and the adder 38 will internally present a logical 1 carry to the next higher adder section. Each of the sum outputs, S0 through S3, is connected to one input of AND gates 40, 42, 44 and 46. The other input of each of these gates is connected to the clear counter signal from NAND gate 26. Each AND gate 40 through 46 has its output connected to shift registers SR0, SR1, SR2, and SR3, each of which is twelve bits in length. This length corresponds directly to the internal timing requirements of the organ system of the preferred embodiment creating twelve channels in the counter 28 which correspond to the assigned tone generators for the respective key pulses. The outputs of each of the shift registers are connected to corresponding counter outputs A0, A1, A2 and A3 and are also fed back to the corresponding B inputs to accomplish the repetitive multiplexed timing scheme necessary for the tonal independence of depressed keys. Specifically, a logical 1 appearing on a sum output will propagate through its associated shift register over a period of twelve bit times. At the end of such period the logical 1 value is fed back to the B input of the adder to retain the placement of the output control signal in its timing sequence for the duration of the count. FIGS. 3A and 3B show respectively multiplexed counter outputs corresponding to keys depressed in the first and fifth tone generator timing periods. FIG. 3C shows the combined multiplexed outputs of the counter 28 as shown in FIGS. 3A and 3B. The feedback loop between the outputs of the shift registers and the B inputs of the adder 38 satisfy the requirements of a four-bit parallel adder, while the number of bits in the shift registers, representative of the number of channels in the controller, satisfy the multiplexing requirements of the electronic musical instrument so as to obtain key independent response. Once NAND gate 32 becomes active on the occurrence of the counter clear signal, it begins to propagate one of the two count source signals to the counting rate input of the counter 28. The counting rate input of exclusive OR gate 48 which has its other input connected to the output of shift register SR0. The output of exclusive OR gate 48 is connected to the adder input A0. A logical 1 value appearing at the A0 input of the adder 38 initiates the count following the occurrence of a clear counter signal. The output of shift register SR0 connected through exclusive OR gate 48 provides for the counter to count at the rate of the count source rather than the much faster system clock rate of electronic musical instrument to the shift registers SR0–SR3.

The maximum value to which the counter 28 counts is determined manually by the depth code setting corresponding to the logical values on the least significant and most significant bit depth code received on the B1 and B2 inputs of the comparator 30. It is preferred that the counter 28 have a maximum count of 16 counting from 0 through 15. However, a shorter count may occur depending upon the logical values received on the B inputs to the comparator 30 or if it is desired to have a different maximum count for other electronic musical instrument timing configurations.

The A1, A2 and A3 outputs of the four-bit multiplexed counter 28 are also connected to exclusive OR gates 50, 52 and 54 respectively. The second input of these exclusive OR gates 50, 52, 54 is connected to the output of AND gate 34. When decayed vibrato is enabled, the output of AND gate 34 will be a logical 1, and the exclusive OR gates, 50, 52, 54 will invert the output information of the counter 28. When delayed vibrato is enabled, the output of AND gate 34 will be a logical 0, and the exclusive OR gates 50, 52, 54 will pass this information without inversion. The outputs of exclusive OR gates 50, 52, 54 are connected to one of the inputs of AND gates 56, 58 and 60 respectively. The other inputs of these AND gates, 56, 58, 60 receive a frequency gating signal FGAT which has passed through an alignment delay device AD5 in order to properly align the FGAT signal in the correct timing period. The FGAT signal is a multiplexed signal indicative of which of the tone generators in the tone generator section 16 of the electronic musical instrument 12 has been assigned by the frequency synthesizer 20 to reproduce the tone corresponding to the depressed key. The FGAT signal is generated by this frequency synthesizer 20 in a time period corresponding to the number of the tone generator which has been assigned. This can be more easily explained by referring to FIG. 5A where a multiplexed key pulse is shown which indicates that a key is depressed for more than one keyboard scan time. A keyboard is scanned in the organ system associated with the present invention once every 384 time periods where such time period is the width of a single key pulse. This key pulse time period spans the complete sequence of tone generator assignment timings of the organ system. The tone generator timing is divided into 12 one microsecond periods, the sum of which is equal to the entire period of one key pulse. The corresponding FGAT signal to the key pulse representing the depressed key occurs two timing periods or bit times following the end of the key pulse period as a positive going pulse occupying the entire second bit time. A bit time is equivalent to one of the one microsecond tone generator timing periods. The FGAT signal will occur in the next higher bit time for each successive key pulse until the maximum number of 12 is achieved with the twelfth FGAT signal appearing in the first bit time period. The CLRP signal referred to above will only occur once in a complete scan time period responsive to a change in the state of the key switch. The CLRP signal appears in the next higher bit time than its related FGAT signal also as a positive going pulse. The ATK signal associated with the same key pulse and its assigned tone generator occurs ten bit times later or in the twelfth bit time and continues to reoccur each twelfth succeeding bit time thereafter during the entire attack and sustain portions of the tone generation. FIG. 5A also shows the counter clear signal appearing as a negative going pulse in the same tone generator timing period as the ATK signal. This is due to the delaying of the CLRP signal in order to align that signal with the ATK signal for creating the counter clear. The counter clear signal occurs only when the CLRP signal is present. It should be noted that the $\overline{BT12}$ pulse, a timing designation, will appear as a negative going pulse in the twelfth tone generator timing period. Its use will be discussed more fully hereinafter.

Referring again to FIG. 1, the FGAT signal is passed through alignment delay AD5 which delays the FGAT signal ten bit times so that the output signals of the counter 28 controlled by exclusive OR gates 50, 52, 54 are passed through AND gates 56, 58, 60 at the correct point in the overall timing scheme. The outputs of AND gates 56, 58, 60 are connected to pulse stretching and alignment delay devices. For ease of explanation only one set of these pulse stretching and alignment delay devices will be described. However, each of the sets of pulse stretchers and alignment delay devices function in an identical manner.

Figures 5C, 5D:
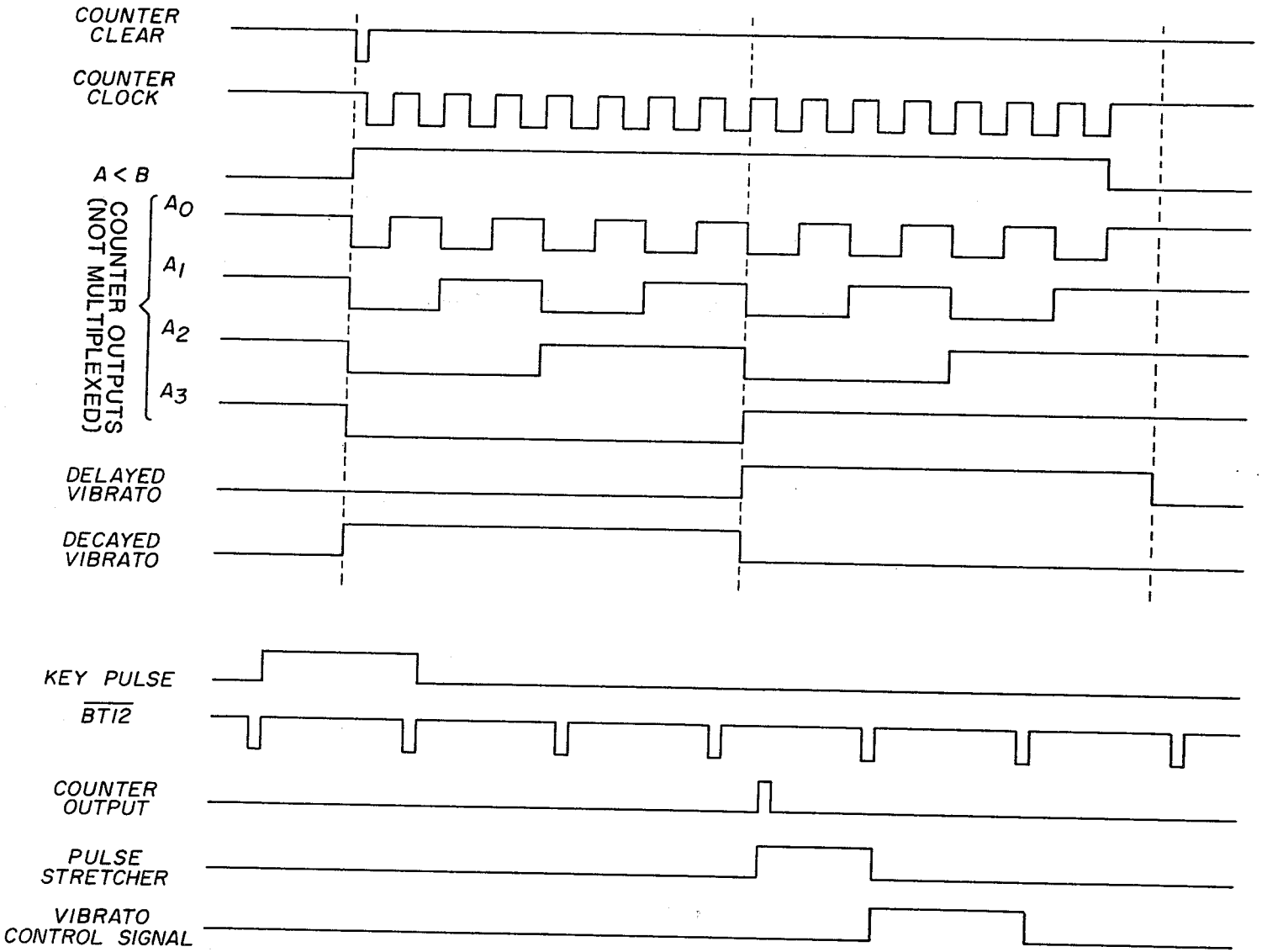
FIG. 5C is a timing diagram showing the relationships in a non-multiplexed format of the counter signals to the "on" times of the dynamic frequency modulation effects of the present invention.
FIG. 5D is a timing diagram showing the relationships in a multiplexed format of the realignment signals of the present invention.
Figure 6:
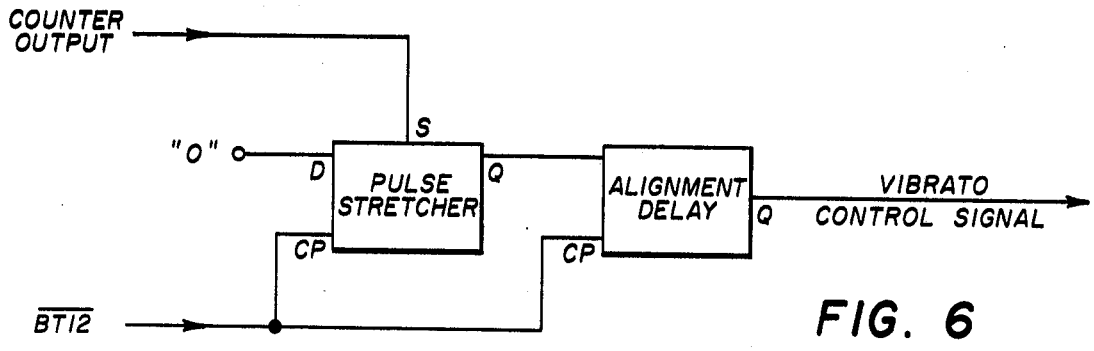
FIG. 6 is a block diagram showing the realignment control portion of the present invention.

As shown in FIGS. 6 and 5D the pulse stretching device, which may be a D-type flip-flop, has its D input connected to a logical 0. The pulse stretching device has its set input connected to the associated counter output through gates 50–60. A positive going pulse from the counter enters the pulse stretching device as it occurs. The pulse stretching device will retain a logical 1 level until the next occurrence of the $\overline{BT12}$ pulse appearing at its clock input, whereby the logical 1 on its Q output is clocked into the associated alignment delay device. The pulse stretcher is simultaneously reset to a logical 0 level. This can be more easily seen by referring to FIG. 5D where the $\overline{BT12}$ pulses reoccur every twelve bit times. A key pulse has been placed in the time period corresponding to the first depressed key which begins on the positive going or trailing edge of $\overline{BT12}$. An hypothetical counter output from one of the AND gates 56, 58, 60 is shown occurring in a bit time period other than the last bit time period. When this occurs, the pulse stretcher will be set to a logical 1 thus retaining the information from the counter 28 until the next occurrence of $\overline{BT12}$ thus stretching the pulse. On that next occurrence of the $\overline{BT12}$ pulse the counter output information will be transmitted to the alignment delay device which will reconstruct the information to be equivalent in length to its corresponding key pulse and delay that information in time until the corresponding key pulse next occurs in the keyboard scanning sequence. If the counter output occurs in the last bit time period, there is no longer a need to retain the information by stretching the pulse. This is because the information is immediately transferred to the alignment delay device by the occurrence of $\overline{BT12}$ in the next bit time period. The above described pulse stretching and alignment delay occurs in each set of devices PS1, AD2; PS2, AD3; and PS3, AD4.

Returning to FIG. 1, the output of alignment delay device AD2 is applied to one input of OR gate 62. The other input of OR gate 62 is connected to the output of NOR gate 64. The inputs of NOR gate 64 are the delayed vibrato enable and the decayed vibrato enable, respectively. If either of the modulation effects is selected, a logical 0 will appear on the output of NOR gate 64 and thus on the input of OR gate 62. OR gate 62 will then pass the delayed vibrato control information to AND gate 66. The second input of AND gate 66 is the vibrato enable signal from the vibrato stop tab. When both inputs of AND gate 66 are logical 1's, a vibrato control signal will be outputted to the frequency synthesizer 20. If neither delayed nor decayed vibrato is enabled, the inputs of NAND gate 64 will be low generating a logical 1 on its output. OR gate 62 will pass the logical 1 to one input of AND gate 66 allowing a vibrato modulation to occur when the vibrato stop tab is enabled. On all of the vibrato enable signal lines, delayed vibrato enable, decayed vibrato enable and vibrato enable, resistors R1, R2 and R3 are attached and used as pull down resistors to create a 0 logic level to the associated gate when the respective enable signal is not present. These resistors may have values of 22K ohms or, depending on the system constraints, any other equivalent values which may be used by one skilled in the art.

The counter output from AND gate 58 passes through pulse stretcher PS2 and the alignment delay device AD3 and is connected to one input of electronic switch ES2. Similarly, the output of AND gate 60 is connected to pulse stretcher PS3 and alignment delay device AD4 and to one input of electronic switch ES3. The other inputs of electronic switches ES2 and ES3 are respectively connected to the most significant bit and the least significant bit of the vibrato depth control. The control inputs of the electronic switches ES2 and ES3 are also connected to the output of NOR gate 64. When the output of NOR gate 64 is a logical 0, the electronic switches ES2 and ES3 are connected to the outputs of alignment delay devices AD3 and AD4 respectively. Thus the electronic switches are connected through their respective pulse stretchers and alignment delay devices to the output of the multiplexed counter 28 only when either delayed or decayed vibrato has been selected. If either delayed or decayed vibrato is not selected, the output of NOR gate 64 will be a logical 1 switching the electronic switches ES2 and ES3 to their alternate input allowing the depth control most significant and least significant bits, respectively, to pass through the dynamic frequency modulation control of the present invention to control the depth of the normal vibrato associated with the electronic musical instrument. The outputs of electronic switches ES2 and ES3 are connected to the frequency synthesizer 20 as shown in FIG. 4.

While the four-bit multiplexed counter 28 will provide count pulses at its outputs corresponding to at least twelve key pulses representing depressed keys on the keyboards of the electronic musical instrument 12, the representation of the timing pulses from the counter corresponding to one depressed key, as shown in FIG. 5C, is sufficient to describe the interaction of the timing and control signals. It should be noted that each of the other timing sequences is equivalent to the one which will be described immediately following. The counter 28 upon the arrival of the counter clear signal resets itself to 0 for that multiplexed time period in which the counter clear signal appears. One of the count sources, whichever is connected to the counting rate input of the counter 28 through electronic switch ES1 and NAND gate 32, provides the counting sequence for controlling the count of counter 28. The count source clock pulse will be present as long as the $A<B$ output of the comparator 30 is a logical 1 enabling the NAND gate 32. The A0–A3 outputs of a single channel of the multiplexed counter 28 shows a count beginning with 0 and ending with 15 as one proceeds from left to right across the graphical representation. The combining of the A3 output of the counter 28 with the logic arrangement of exclusive OR gate 50, AND gate 34 and inverter 36 controls the selection of decayed or delayed vibrato; decayed vibrato occurring during the first eight counts and delayed vibrato occurring during the last eight counts of counter 28. The A0 output of counter 28 is not used as a control source because of the asynchronous relationship of the count source and the initiation of the control signals corresponding to a depressed key. This asynchronous relationship may severely curtail or entirely eliminate the first count. At best, the control signals may only foreshorten the first count pulse. However, the foreshortening or any other random variation of the first count pulse will not affect the output control signals as severely as it would if the A0 output were used as a control signal. The only effect is the lessening by a small degree of the overall variation in the counting cycle.

The sequence of events for delayed vibrato is as follows. A key is depressed on a keyboard of the digital electronic musical instrument 12 which, with either the ATK or PNO signal, clears the counter 28 initiating a counting cycle corresponding to that key depression. When the counter output A3 goes to a logical 1 half way through its counting cycle, the exclusive OR gate 50 receives a logical 1 on one of its inputs and a logical 0 from AND gate 34 on its other input allowing the logical 1 from the counter 28 to pass through without inversion creating a vibrato control signal indicative of delayed vibrato to the frequency synthesizer 20. Thus the vibrato effect is enabled but only after a delay proportional to the rate of the count source of the multiplexed counter 28. As the counter 28 continues to count, its A2 and A1 outputs generate a maximum count code of 4 which is ultimately applied to the depth code input of the frequency synthesizer 20. See FIG. 4. Since the exclusive OR gates 52 and 54 are receiving a logical 0 on one of their inputs, they will not invert the signals generated by the A2 and A1 outputs of the counter 28 and therefore it will appear that the counter is counting upwards. This upward counting of the counter 28 will cause the vibrato depth to gradually increase after the delay period. The gradually increasing vibrato depth will reach a maximum value which is determined manually by setting a depth control (not shown) having outputs corresponding to the least significant and most significant bits of the depth code monitored by the B1 and B2 inputs respectively of the comparator 30. When the A outputs of the counter are equal to the B inputs of the comparator, the $A<B$ output of the comparator 30 will switch to a logical 0 level disabling the count for that channel. The count will be retained without change on that channel of the counter 28 until a counter clear signal is received for that channel by appearing in the proper time period. This permits the vibrato effect to continue at its preselected depth until the associated key is released.

In the decayed vibrato mode the output of AND gate 34 will become a logical 1. This causes the exclusive OR gates 50, 52 and 54 to invert the input signals received from the counter 28. Therefore, the counter with decayed vibrato enabled will, with this logic sequence, cause the counter to act as if it were counting downward. The operating sequence in the decayed vibrato mode is to enable a full vibrato depth immediately upon the depression of the key followed by a gradual decrease in that depth based on the A2 and A1 outputs of the counter 28 at a rate determined by the count source being used. When the A3 output of counter 28 becomes a logical 1, the decayed vibrato effect will become disabled because logical 1's will appear on both inputs of exclusive OR gate 50 causing a logical 0 at its output ultimately causing the vibrato control signal to cease. The vibrato depth control for the decayed vibrato function responds identically to the vibrato depth described above for the delayed vibrato function with the exception that a decrease in depth rather than an increase occurs. This decrease in depth of the vibrato results in only the normal tone associated with the depressed key to sound after the decay is complete.

Figure 7A:
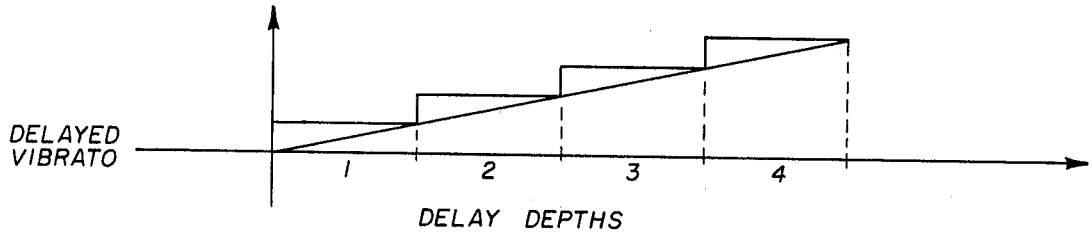
FIG. 7A is a graph showing two forms of differing depths of delayed vibrato.
Figure 7B:
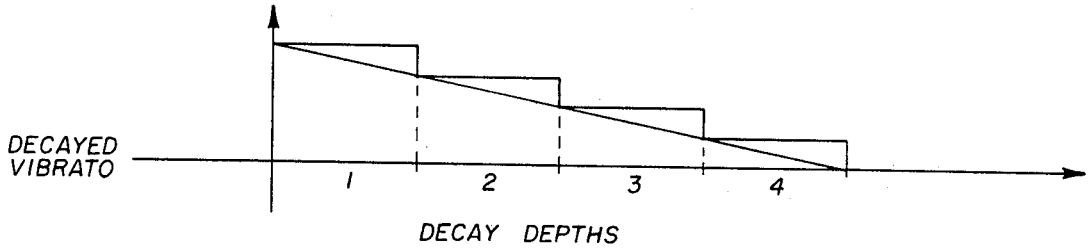
FIG. 7B is a graph showing two forms of differing depths of decayed vibrato.

Some of the differing depths which are usable for either delayed or decayed vibrato are shown in FIGS. 7A and 7B. The depths of these effects may increase or decrease in a linear manner or in a stepped level manner according to the design of the controls of the organ system. Any other depth variations such as a logarithmically varying depth level may be acceptable with only the taste of the designer of an electronic musical instrument being the controlling factor. As described above the depth increases for delayed vibrato as the count on the A1 and A2 outputs of the counter 28 increases during the second half of its count. Likewise, the depth decreases for the decayed vibrato as the count on the A1 and A2 outputs of the counter 28 increase during the first half of its count due to the inversion of their inputs by exclusive OR gates 52 and 54. The counting rate is controlled by a count source such as a 555 timer, a voltage controlled oscillator, or an equivalent thereto such as can be constructed by one skilled in the art. While a single count source may be used to control the counting rate of the multiplexed counter 28, it is preferred that different count sources, i.e., count source A and count source B, be used for each of the two vibrato effects. The reason for this is that each of the effects requires a different and distinct counting rate so that the dynamic effect on the reproduced tone is truer to that which is desired by the designer. To increase the user's control over the selected effect, the count sources A and B are controllable by variable resistors 68 and 70, respectively. In this manner each of the sources can individually vary the counting rate of the multiplexed counter 28 for the corresponding effect. See FIG. 4. The variable resistors 68 and 70 vary the rate of their respective count sources over a range of 5 to 30 Hz for the complete excursion of a count pulse time. This varies the length of time that a modulation level is retained and ultimately the length of the overall period. Of course, other count pulse timing rates may be just as suitable and would depend only on the taste of the electronic musical instrument designer as he listens to the resulting effects on the reproduced tones.

The present invention may be embodied in other specific forms without departing from the spirit or essential attributes thereof and, accordingly, reference should be made to the claims, rather than to the foregoing specification as indicating the scope of the invention.

I claim:

1. In an electronic musical instrument having at least one keyboard with keys corresponding to the notes of a musical scale apparatus for controlling the dynamic frequency modulation of tones reproduced from key pulses associated with active keys of the keyboard comprising:

(a) tonal effect control means for selecting one of the desired modulation effects;

(b) counting means having a plurality of distinct sequential time periods for creating a delay proportional to its counting rate for generating a first output signal having a timing indicative of the selected modulation effect and second and third output signals indicative of the depth for each effect;

(c) triggering means for initiating individually a count in each of the time periods of the counting means in response to the generation of a key pulse resulting from the activation of a key;

(d) count source means for controlling the counting rate of the counting means;

(e) comparator means for disabling the count in any of the time periods of the counting means when output control signals reach a preselected value;

(f) timing alignment means for realigning the first, second and third output control signals of the counting means with the corresponding key pulse;

whereby the frequency modulated tone reproduced in response to a key pulse and the output control signals of the counting means corresponding to such key pulse will be independent of the effect of any key pulses occurring either prior or subsequent thereto.

2. Apparatus as in claim 1 wherein the counting means includes at least as many time periods as there are tone generators in the electronic musical instrument.

3. Apparatus as in claim 1 wherein the count source means includes means for varying the rate of modulation deviation of the effect over the entire period associated with such effect by regulating the output pulse rate of the count source means.

4. Apparatus as in claim 1 wherein the second and third output signals of the counting means provide either an increasing or a decreasing depth control signal depending on the selected modulation effect over the entire period associated with such effect.

5. Apparatus as in claim 1 wherein the comparator means comprises a means for comparing the values of the output signals of the counting means with preselected values indicative of a maximum allowable count for disabling the counts of the associated time period of the counting means when the values of the output control signals reach the preselected values.

6. In an electronic musical instrument having at least one keyboard with keys corresponding to the notes of a musical scale apparatus for controlling the dynamic frequency modulation of tones reproduced from key pulses associated with active keys of the keyboard comprising:

(a) tonal effect control means for selecting one of the desired modulation effects;

(b) counting means having at least as many distinct sequential time periods as there are tone generators in the electronic musical instrument for creating a delay proportional to its counting rate for generating a first output control signal having a timing indicative of the selected modulation effect and second and third output control signals indicative of the depth for each such effect wherein the second and third output control signals of the counting means provide either an increasing or a decreasing depth control signal depending on the selected modulation effect over the entire period associated with such effect;

(c) triggering means for initiating individually a count in each of the time periods of the counting means in response to the generation of a key pulse resulting from the activation of a key;

(d) count source means for controlling the counting rate of the counting means including control means for varying the rate of modulation deviation of the selected effect over the entire period associated with such effect by regulating the output pulse rate of the count source means;

(e) comparator means for disabling the count in any of the time periods of the counting means by comparing the values of the output control signals of the counting means with preselected values indicative of a maximum allowable count wherein the count of the associated time period of the counting means will be disabled when the values of the output control signals reach the preselected values;

whereby the frequency modulated tone reproduced in response to a key pulse and the output control signals of the counting means corresponding to such key pulse will be independent of the effect of any key pulses occurring either prior or subsequent thereto.

7. Apparatus as in claim 1 or 6 wherein the desired modulation effects comprise a group consisting of vibrato, delayed vibrato, and decayed vibrato.

8. In an electronic organ of the type having at least one keyboard with keys corresponding to the notes of a musical scale apparatus for controlling the dynamic frequency modulation of tones reproduced from key pulses associated with active keys of the keyboard wherein the time variant parameters of the modulation are responsive to individually depressed keys comprising:

(a) modulation selection control means for selecting one of the desired modulation effects;

(b) multiplexed counter means having a plurality of distinct sequential time periods for creating a delay proportional to its counting rate for generating first, second and third output signals for controlling the time variant parameters of the modulation effects;

(c) triggering means for initiating individually a count in each of the time periods of the counter means in response to the generation of a key pulse resulting from the actuation of a key;

(d) count source means for controlling the counting rate of the counter means;

(e) comparator means for disabling the count in any of the time periods of the counter means;

(f) timing alignment means for realigning the first, second and third output control signals of the counter means with the corresponding key pulse;

whereby the frequency modulated tone reproduced in response to a key pulse and the output control signals of the counter means corresponding to such key pulse will be for any keying sequence independent of the effect of any key actuations occurring either prior or subsequent thereto.

9. An electronic organ as in claim 8 wherein the desired modulation effects comprise a group consisting of vibrato, delayed vibrato and decayed vibrato.

10. An electronic organ as in claim 8 wherein:

(a) said first output signal generated by the counter means having a timing indicative of the selected modulation effect;

(b) said second and third output signals generated by the counter means are indicative of the depth of the selected modulation effect.

11. An electronic organ as in claim 10 wherein said second and third output signals generated by the counter means provide either an increasing or decreasing depth control signal depending on the selected modulation effect over the entire period associated with such effect.

12. An electronic organ as in claim 8 wherein said count source means includes means for varying the rate of modulation deviation of the effect over the entire period associated with such effect by regulating the output pulse rate of the count source means whereby the counter means will have an increased or decreased counting rate shortening or lengthening the period associated with the effect.

13. An electronic organ as in claim 12 wherein said output pulse rate of the count source means may vary over the range of 5–30 Hz for the complete excursion of one count pulse time.

14. An electronic organ as in claim 8 wherein the counter means includes at least as many time periods as there are tone generators in the organ.

15. An electronic organ as in claim 8 wherein the comparator means further comprises means for comparing the values of the output signals of the counter means with preselected values indicative of a maximum allowable count for disabling the count in any one of the time periods of the counter means when the values of the output signals reach the preselected values.

16. An electronic organ as in claim 15 wherein the preselected values establish the depth of the selected modulation effect by setting the maximum allowable count.

* * * * *